US009102168B2

(12) United States Patent
Kueckendahl et al.

(10) Patent No.: US 9,102,168 B2
(45) Date of Patent: Aug. 11, 2015

(54) METHOD FOR APPLYING A MARKING ON AN OBJECT AND MARKING APPARATUS

(75) Inventors: Peter Joerg Kueckendahl, Bad Oldesloe (DE); Daniel Joseph Ryan, Sycamore, IL (US)

(73) Assignee: Alltec Angewandte Laserlicht Technologie GMBH, Selmsdorf (DE)

( * ) Notice: Subject to any disclaimer, the term of this patent is extended or adjusted under 35 U.S.C. 154(b) by 0 days.

(21) Appl. No.: 13/976,804

(22) PCT Filed: Dec. 22, 2011

(86) PCT No.: PCT/EP2011/006516

§ 371 (c)(1),
(2), (4) Date: Jun. 27, 2013

(87) PCT Pub. No.: WO2012/089321

PCT Pub. Date: Jul. 5, 2012

(65) Prior Publication Data

US 2013/0286147 A1 Oct. 31, 2013

(30) Foreign Application Priority Data

Dec. 30, 2010 (EP) ..... 10016199

(51) Int. Cl.
*B41J 2/00* (2006.01)
*B41J 29/393* (2006.01)
(Continued)

(52) U.S. Cl.
CPC .. *B41J 2/435* (2013.01); *B41J 2/46* (2013.01); *B41J 11/008* (2013.01)

(58) Field of Classification Search
CPC ..... B41J 11/008; B41J 2/435; B41J 2/46; B41J 3/00
USPC ..... 347/110, 19, 225, 151, 229, 240, 247, 347/9, 43, 224, 20, 40, 117, 238, 236, 246
See application file for complete search history.

(56) References Cited

U.S. PATENT DOCUMENTS 4,707,063 A 11/1987 Plummer
5,399,032 A 3/1995 Itoh et al.
(Continued)

FOREIGN PATENT DOCUMENTS

DE 2401322 1/1974
DE 3826113 A1 2/1989
(Continued)

OTHER PUBLICATIONS

International Application No. PCT/EP20111006516, Written Opinion of International Search Authority.
(Continued)

*Primary Examiner* — Sarah Al Hashimi
(74) *Attorney, Agent, or Firm* — Hoffman Warnick LLC

(57) ABSTRACT

The invention relates to a method for applying a marking on an object, wherein the object is moved in an advance direction relative to a marking head comprising a plurality of marking devices and the marking is applied on the object by means of the plurality of marking devices during the relative movement between the object and the marking head. For applying the marking on a predetermined marking area relative to a transverse direction, which extends transversely to the advance direction, a position of the object in the transverse direction is determined and based on the determined position of the object in the transverse direction a first number of marking devices is deactivated and a second number of marking devices is activated, wherein the marking is applied on the object by the second number of marking devices. The invention also relates to a marking apparatus for applying a marking on an object.

12 Claims, 11 Drawing Sheets

(51) Int. Cl.

| | |
|---|---|
| ***B41J 2/47*** | (2006.01) |
| ***B41J 2/435*** | (2006.01) |
| ***B41J 2/015*** | (2006.01) |
| ***B41J 2/385*** | (2006.01) |
| ***B41J 2/45*** | (2006.01) |
| ***B41J 2/46*** | (2006.01) |
| ***B41J 11/00*** | (2006.01) |

(56) References Cited

U.S. PATENT DOCUMENTS

| | | | | |
|---|---|---|---|---|
| 5,477,259 | A | 12/1995 | Iwasa | |
| 5,777,634 | A | 7/1998 | Okamura et al. | |
| 5,784,098 | A | 7/1998 | Shoji et al. | |
| 6,189,991 | B1 | 2/2001 | Wen et al. | |
| 6,286,927 | B1 | 9/2001 | Taneya et al. | |
| 6,381,377 | B1 | 4/2002 | Wang | |
| 6,469,729 | B1 | 10/2002 | Ryan | |
| 6,738,086 | B2 | 5/2004 | Oka | |
| 6,855,921 | B1 | 2/2005 | Stopperan et al. | |
| 7,354,130 | B2 | 4/2008 | Arakawa | |
| 7,448,719 | B1 | 11/2008 | Newell | |
| 7,564,020 | B2 | 7/2009 | Sergyeyenko | |
| 7,671,337 | B1 | 3/2010 | Tidwell | |
| 7,908,968 | B2 | 3/2011 | McCoin et al. | |
| 2002/0001004 | A1 | 1/2002 | Mantell et al. | |
| 2002/0101469 | A1 | 8/2002 | Wade et al. | |
| 2002/0109741 | A1 | 8/2002 | Okabe et al. | |
| 2002/0139273 | A1 | 10/2002 | Murata et al. | |
| 2002/0191069 | A1 | 12/2002 | Oka | |
| 2003/0016348 | A1 | 1/2003 | Sallee | |
| 2003/0210861 | A1 | 11/2003 | Weiss et al. | |
| 2003/0235373 | A1 | 12/2003 | Ishii et al. | |
| 2004/0160478 | A1* | 8/2004 | Weijkamp et al. | 347/43 |
| 2005/0122548 | A1 | 6/2005 | Cunnigan et al. | |
| 2005/0123303 | A1 | 6/2005 | Guttman et al. | |
| 2005/0140770 | A1* | 6/2005 | Kang et al. | 347/198 |
| 2005/0286093 | A1 | 12/2005 | Sumi et al. | |
| 2006/0066924 | A1* | 3/2006 | Delueg | 358/506 |
| 2006/0109525 | A1 | 5/2006 | Evans | |
| 2007/0091132 | A1* | 4/2007 | Lim | 347/14 |
| 2007/0279713 | A1 | 12/2007 | Feng et al. | |
| 2008/0055352 | A1 | 3/2008 | Toh et al. | |
| 2008/0246962 | A1 | 10/2008 | Yang | |
| 2010/0002057 | A1* | 1/2010 | Hatasa et al. | 347/50 |
| 2010/0102032 | A1* | 4/2010 | Bathelet | 216/84 |
| 2010/0214387 | A1 | 8/2010 | Fox et al. | |
| 2010/0231929 | A1 | 9/2010 | Kakigi | |
| 2013/0021398 | A1 | 1/2013 | Mizes et al. | |
| 2013/0286147 | A1 | 10/2013 | Kueckendahl et al. | |
| 2013/0286148 | A1 | 10/2013 | Kueckendahl et al. | |
| 2013/0286149 | A1 | 10/2013 | Kueckendahl et al. | |
| 2013/0293658 | A1 | 11/2013 | Kueckendahl et al. | |
| 2013/0328978 | A1 | 12/2013 | Sekino et al. | |
| 2013/0342823 | A1 | 12/2013 | Kueckendahl et al. | |

FOREIGN PATENT DOCUMENTS

| | | | |
|---|---|---|---|
| EP | 0121369 | A2 | 10/1984 |
| EP | 0832754 | B1 | 12/1993 |
| EP | 0832752 | A2 | 4/1998 |
| EP | 1266763 | A1 | 12/2002 |
| EP | 1640169 | A3 | 9/2005 |
| EP | 1640169 | A2 * | 3/2006 |
| EP | 1640169 | A3 | 10/2007 |
| EP | 2105309 | A1 | 9/2009 |
| JP | 59136267 | | 8/1984 |
| JP | 05185686 | | 7/1993 |
| JP | 2001332806 | A | 11/2001 |
| JP | 2007090814 | A | 4/2007 |
| JP | 2008126471 | A | 6/2008 |
| JP | 2009037128 | A * | 2/2009 |
| WO | 8505187 | A1 | 11/1985 |
| WO | 2006037973 | A1 | 4/2006 |
| WO | 2007107030 | A1 | 9/2007 |
| WO | 20080104222 | A1 | 9/2008 |
| WO | 2009153795 | A1 | 12/2009 |

OTHER PUBLICATIONS

International Application No. PCT/EP20111006516, International Search Report, dated Mar. 23, 2012, 3 pages.
International Application No. PCT/EP2011/006515, Written Opinion on Search Report.
International Application No. PCT/EP2011/00652023, Written Opinion of International Search Authority.
International Application No. PCT/EP2011/006518, Written Opinion of International Search Authority.
U.S. Appl. No. 13/976,779, Office Action dated Jun. 16, 2014.
U.S. Appl. No. 13/976,804, Notice of Allowance dated Mar. 20, 2014.
U.S. Appl. No. 13/976,809, Office Action dated May 27, 2014.
International Application No. PCT/EP2011/006514, Written Opinion of International Search Authority.
International Application No. PCT/EP2011/006519, Written Opinion of International Search Authority.
International Application No. PCT/EP2011/006519, Preliminary Report on Patentability.
U.S. Appl. No. 13/976,793, Office Action dated Jul. 1, 2014.
U.S. Appl. No. 13/977,151, Notice of Allowance and Fees Due dated Aug. 4, 2014.
U.S. Appl. No. 13/977,156, Office Action dated Jul. 9, 2014.
International Application No. PCT/EP2011/006517, Written Opinion of International Search Authority, Jun. 30, 2013
International Application No. PCT/EP2011/006516, Written Opinion of International Search Authority, Jun. 30, 2013.
International Application No. PCT/EP2011/006519, Written Opinion of International Search Authority, Jun. 30, 2013.
International Application No. PCT/EP2011/006519, Preliminary Report on Patentability, Jun. 30, 2013.
International Application No. PCT/EP2011/006520, Written Opinion of International Search Authority, Jun. 30, 2013.
International Application No. PCT/EP2011/006521, Written Opinion of International Search Authority, Jun. 30, 2013.
International Application No. PCT/EP2011/006521, Written Opinion of International Examining Authority, Aug. 3, 2013.
U.S. Appl. No. 13/976,832, Notice of Allowance dated Jun. 24, 2014, 19 pages.
U.S. Appl. No. 13/976,832, Notice of Allowance dated Oct. 8, 2014, 61 pages.
U.S. Appl. No. 13/976,814, Notice of Allowance dated Oct. 21, 2014, 72 pages.
U.S. Appl. No. 13/977,159, Office Action dated Jun. 20, 2014, 11 pages.
U.S. Appl. No. 13/977,159, Final Office Action dated Oct. 10, 2014, 53 pages.
U.S. Appl. No. 13/977,156, Final Office Action dated Dec. 5, 2014, 13 pages.
U.S. Appl. No. 13/976,793, Notice of Allowance dated Dec. 9, 2014, 66 pages.
U.S. Appl. No. 13/976,779, Notice of Allowance dated Oct. 21, 2014, 34 pages.
U.S. Appl. No. 13/976,814, Notice of Allowance Dated Dec. 29, 2014, 10 pages.
U.S. Appl. No. 13/976,793, Notice of Allowance Dated Feb. 4, 2015, 16 pages.
U.S. Appl. No. 13/976,779, Notice of Allowance Dated Feb. 6, 2015, 18 pages.
U.S. Appl. No. 13/976,809, Office Action dated Feb. 6, 2015, 11 pages.
U.S. Appl. No. 13/977,151, Office Action dated Feb. 17, 2015, 70 pages.
U.S. Appl. No. 13/977,159, Notice of Allowance dated Feb. 17, 2015, 15 pages.
International Application No. PCT/EP2011/006514, Written Opinion of International Search Authority, Jun. 30, 2013.
International Application No. PCT/EP2011/006518, Written Opinion of International Search Authority, Jun. 30, 2013.

(56) References Cited

OTHER PUBLICATIONS

International Application No. PCT/EP2011/006515, International Preliminary Report on Patentability, Jan. 21, 2013.
International Application No. PCT/EP2011/006515, Written Opinion on Search Report, Jun. 30, 2013.
International Application No. PCT/EP2011/006522, Written Opinion of International Search Authority, Jun. 30, 2013.
International Application No. PCT/EP2011/006522, International Report on Patentability, Jan. 17, 2013.
International Application No. PCT/EP2011/00652023, Written Opinion of International Search Authority, Jun. 30, 2013.
U.S. Appl. No. 13/977,156, Notice of Allowance dated Mar. 16, 2015, 21 pgs.

* cited by examiner

METHOD FOR APPLYING A MARKING ON AN OBJECT AND MARKING APPARATUS

FIELD OF THE INVENTION

The present invention relates to a method for applying a marking on an object and a marking apparatus.

RELATED ART

In a known marking operation, the object is moved in an advance direction relative to a marking head comprising a plurality of marking devices and the marking is applied on the object by means of the plurality of marking devices during the relative movement between the object and the marking head.

A known marking apparatus comprises a marking head having a plurality of marking devices for applying the marking on the object and a driving mechanism for providing a relative movement of the object relative to the marking head in an advance direction during a marking operation.

In many applications, the object to be marked is moved by conveyors, belts or other moving devices. The object is most often guided during the movement so that a movement of the object in a transverse direction is prevented. However, in some applications it is hard or even impossible to guide the object with the required accuracy, for example due to the material of the object, in particular, if the object is a paper, carton and/or plastic foil.

If the object is not properly guided in the transverse direction during the marking operation the marking quality might be reduced and/or the marking might be displaced in the transverse direction.

SUMMARY OF THE INVENTION

It is an object of the invention to provide a method for applying a marking on an object and a marking apparatus having an enhanced marking quality.

The object is solved according to the invention with a method for applying a marking on an object and a marking apparatus.

An inventive method is characterized in that for applying the marking on a predetermined marking area relative to a transverse direction, which extends transversely to the advance direction, a position of the object in the transverse direction is determined and based on the determined position of the object in the transverse direction a first number of marking devices is deactivated and a second number of marking devices is activated, wherein the marking is applied on the object by the second number of marking devices.

An inventive marking apparatus is characterized in that at least one sensor device is arranged in the marking head, the at least one sensor device being configured to determine a position of the object in a transverse direction, which extends transversely to the advance direction, and the marking devices can be individually activated and deactivated based on the determined position of the object in the transverse direction.

One idea of the invention is to accept a possible displacement of the object in the transverse direction and to compensate this transverse displacement by adapting the position of the marking devices in the transverse direction according to the displacement of the object.

Another idea of the invention is to provide more marking devices than are necessary to apply the marking on the object in order to extend the possible marking width in the transverse direction. Thus, the number of marking devices present in the marking head is greater than the number of marking devices needed for applying the marking on the object.

For the adjustment of the position of the marking to be applied, according to the invention it is not necessary to mechanically move the marking devices relative to the object. Instead, if the object is displaced in the transverse direction, the marking operation is performed by those marking devices which correspond to the actual position of the object, so that the marking is applied at the predetermined or desired marking area or marking position on the object. Thus, the marking operation is shifted from a base subset of marking devices corresponding to a base position of the object to an adapted subset of marking devices corresponding to a displaced position of the object. Generally there may be an overlapping between the base subset of marking devices and the adapted subset of marking devices.

According to the invention, the marking head comprises a plurality of marking devices, wherein for performing a marking operation a first subset of the marking devices is in an inactive state and a second subset of the marking devices is in an active state. The deactivated marking devices are those marking devices that are not used during a marking operation. The activated marking devices are those marking devices, that are employed for marking the object.

It may be noted that the activated marking devices are not necessarily operated during the entire marking operation or marking process. The marking can in particular be applied by a successive operation of the activated marking devices. More particularly, the activated marking devices may be operated successively for applying the marking pixel per pixel during the movement of the object relative to the marking devices.

The marking devices may in particular be marking devices for marking, printing and/or engraving the object with at least one laser beam. In a preferred embodiment the marking devices comprise a ferrule with a fibre coupled to a laser device. However, the marking devices can also include other types of marking devices such as inkjet nozzles, thermal printing devices, needle printing devices, micro pad printing devices, water jets and/or electrical discharge machining devices. It is also possible to include different types of marking devices in the marking head.

The sensor devices may for example comprise a ferrule with at least one fibre arranged therein, a PIN diode, a photo diode, a photo transistor, a micro antenna, a capacity sensor element, an inductive sensor element and/or a chemical sensor element. The sensor devices may in particular be optical sensor devices and may be configured to detect a colour profile, in particular a black and white colour profile, on the object.

In a preferred embodiment the marking apparatus is a printing apparatus for printing or engraving an object by means of at least one laser beam.

In a method for applying a marking on the object, the object can be marked or printed at least in part by a successive operation of the individual marking devices, that is, the marking may be applied line by line or pixel by pixel.

In a preferred embodiment of the invention the position of the object in the transverse direction is determined before the marking is applied on the object. The position of the object in the transverse direction is in particular determined or measured right before marking. Based on the determined position of the object, a plurality of marking devices, that is, the second subset of the marking devices, will be activated for applying the marking on the object.

In a preferred configuration the activated marking devices will remain the same during a complete marking operation of one object. The position of the object may be determined before the marking operation starts and based on the determined position of the object the subset of activated marking devices may be elected. The once elected activated marking devices may subsequently perform the complete marking operation of the object.

In particular, if the object shows a jitter movement, it may be preferred that the position of the object in the transverse direction is determined during a marking operation. In particular, it may be preferred that the position of the object in the transverse direction is continuously or repeatedly determined during the marking operation and the subset of activated marking devices is adapted to the determined position of the object during the marking operation. Thus, the activated marking devices can be determined dynamically during a marking operation of one object in order to compensate a jitter movement of the object.

In a preferred embodiment the position of the object in the transverse direction is determined by detecting the position of a sensing area, in particular a contrast area, on the object. A contrast area may in particular be an area on the object with contrast changes in the transverse direction. A contrast change may for example be a change from a light colour to a dark colour, such as a change from white to black, or vice versa. Such a high contrast change in the transverse direction can be detected by a suitable detector means such as an optical sensor.

It may be preferred that for detecting the position of the contrast area on the object, light is transmitted to the object, the light is at least partly reflected and/or scattered by the object and the reflected and/or scattered light is detected by a sensor element. The light may be visible light, infrared light and/or any other type of electromagnetic radiation. The sensor elements may comprise one or more photo diodes or photo sensors.

If the displacement of the object in the transverse direction shall be sensed just once before marking the object, only a small sensing area may be needed. The sensing area may preferably be located on the object such that it will pass the marking head before the marking area, when the object is moved in the advance direction, in order to detect the displacement of the object before the actual marking process starts.

If, on the other hand, a jitter needs to be compensated while marking the object, the sensing area may preferably extend along a major portion of marking area in the advance direction. The sensing area should ideally span at least the same distance in the advance direction as the marking area or be larger than the marking area. This allows for a continuous or repeated measurement during the entire marking process. If the sensing area does not span the entire marking distance and/or has discontinuities interpolation can be applied.

In a preferred embodiment of the invention a marking image being a model of the marking to be applied on the object and having a plurality of pixels is pre-processed by shifting the pixels in a predetermined manner based on the determined position of the object in the transverse direction and the pre-processed marking image is employed for activating and/or deactivating the marking devices. The pre-processing of the marking image may be performed in a processing unit of the marking apparatus and may—in addition to the determined position of the object—take into account the configuration of the marking devices in the marking head.

In a preferred embodiment of the marking apparatus the at least one sensor device is arranged upstream of the marking devices in the advance direction. Accordingly, the position of the object can be measured and the marking devices can be adjusted before performing the marking operation.

A very flexible marking head can be provided if the marking head comprises a plurality of receiving spaces for individual marking devices arranged in a two-dimensional array. The receiving spaces can be entirely or partially equipped with marking devices.

In another preferred embodiment of the invention the at least one sensor device is arranged in one of the receiving spaces of the array, in particular in a receiving space upstream of the marking devices in the advance direction. It may be particularly preferred that the receiving spaces of the marking head are configured to be selectively equipped with marking devices and/or sensor devices. Moreover, it may be preferred that the marking devices and the at least one sensor device have corresponding connector sections, so that a receiving space of the marking head may be selectively equipped with a marking device or a sensor device.

In a preferred embodiment the receiving spaces of the marking head are receiving holes formed in a receiving plate. The receiving holes may in particular be through-holes. The marking devices and the at least one sensor device may be inserted into the receiving holes and thereby coupled to the receiving plate.

In another preferred embodiment of the invention the array of receiving spaces comprises a plurality of rows extending in the transverse direction and the array is arranged in a position, in which the receiving spaces of a successive row are offset with regard to the receiving spaces of a preceding row in the transverse direction. Such a two-dimensional array, in which the receiving spaces of a successive row are interposed between receiving spaces of a preceding row in the advance direction, allows for an enhanced resolution of the marking. The smaller the offset and the greater the number of rows, the greater is the resolution to be achieved.

In a preferred embodiment the array of receiving spaces is an orthogonal array, in which the receiving spaces are arranged in rows and columns extending perpendicularly to each other. In such an orthogonal array the receiving spaces are arranged in a rectangular pattern. In a preferred embodiment, the array is slightly inclined or tilted, so that the receiving spaces of a successive row are offset with regard to the receiving spaces of a preceding row. The amount of offset is preferably smaller than a pitch between the receiving spaces of one row, wherein the pitch is defined as the distance between two adjacent or adjoining receiving spaces of one row.

In another preferred embodiment the receiving spaces have an equal spacing in a row direction and/or a column direction. In other words, the pitch of the receiving spaces in the row direction and/or their column direction is equal throughout the marking head. The equal pitch allows for a constant resolution of the marking to be applied. Moreover, a marking head with such a pattern of receiving spaces can be fabricated.

In another preferred embodiment of the invention the at least one sensor device comprises a ferrule, in which are arranged a transmitting fibre for transmitting light to the object and a receiving fibre for receiving light reflected from the object. One idea of this embodiment is to provide a sensor device having a plurality of optical fibres arranged in a common housing called a ferrule. In particular, the ends of the fibres may be arranged in the ferrule. The ferrule may be adapted to tightly hold the fibre ends arranged therein, that is, to tightly hold the ends of at least one transmitting fibre and at least one receiving fibre.

In a preferred embodiment the ferrule has a body having a substantially cylindrical outer shape to be inserted into a cylindrical receiving hole of the marking head.

Moreover, it may be preferred that the ferrule has a keyed body for being inserted into a receiving hole of the marking head in a defined angular position. The keyed ferrule may be placed in a receiving hole having a corresponding keying.

It may be particularly preferred that the keying includes a groove or tongue extending along a longitudinal axis of the ferrule. The ferrule may also have a profiling or a profiled pattern for being inserted into the receiving hole in a defined angular position.

The keyed ferrule can improve the accuracy of the determination of the displaced position due to the known position of the receiving or sensing fibre in the ferrule relative to the array.

It may also be preferred that the ferrule has a body with a polygonal cross-section for being inserted into a receiving hole of a marking head in a defined angular position. The polygonal cross-section may in particular be a triangle or a rectangle. The receiving hole may have a corresponding cross-section according to the cross-section of the ferrule.

Furthermore, it may be preferred that the ferrule has a molded body. The technology of molding may be an advantageous manufacturing technology in order to provide a robust body with precise predetermined dimensions.

In a preferred embodiment at least a part of the marking devices comprises a body with a ferrule shape. The combination of marking devices having a ferrule-shaped body and at least one sensor device also having a ferrule-shaped body provides a flexible marking apparatus, in which marking devices and sensor devices may be exchanged.

In order to more accurately determine the position of the object in the transverse direction, it may be preferred to provide a plurality of sensor devices in the marking head. It may be particularly preferred to arrange the plurality of sensor devices in a two-dimensional array. More particularly, it may be preferred that the sensor devices are arranged in an array having a plurality of rows, in which the sensor devices are arranged, wherein the sensor devices of a successive row are offset with regard to the sensor devices of a preceding row in the transverse direction. In particular, it may be preferred that the sensor devices are arranged in a corresponding manner, as described in connection with the marking devices.

BRIEF DESCRIPTION OF THE DRAWINGS

The invention will be further described with reference to the attached figures, wherein.

In all figures, identical components are identified by identical reference signs.

DETAILED DESCRIPTION OF THE INVENTION

Figure 1:
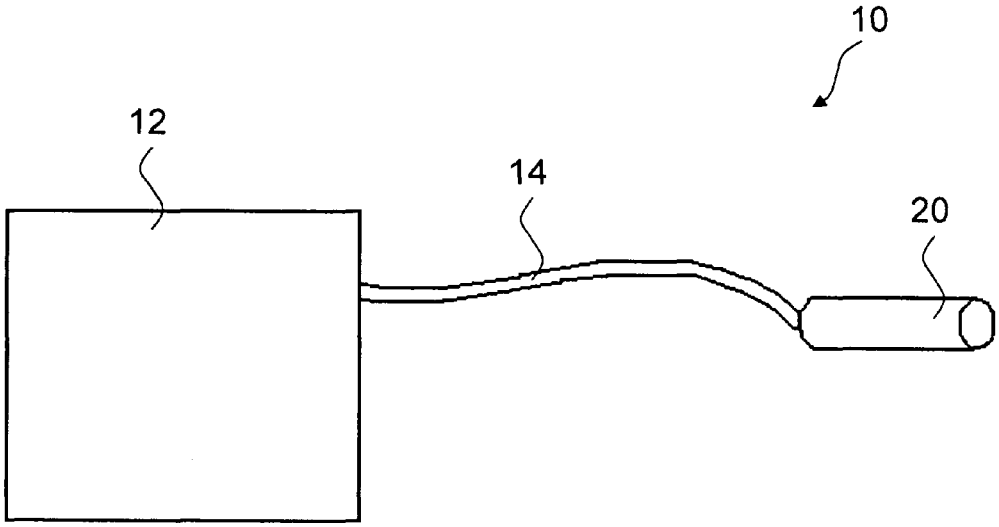
FIG. 1 shows a marking apparatus according to the invention.
Figure 2:
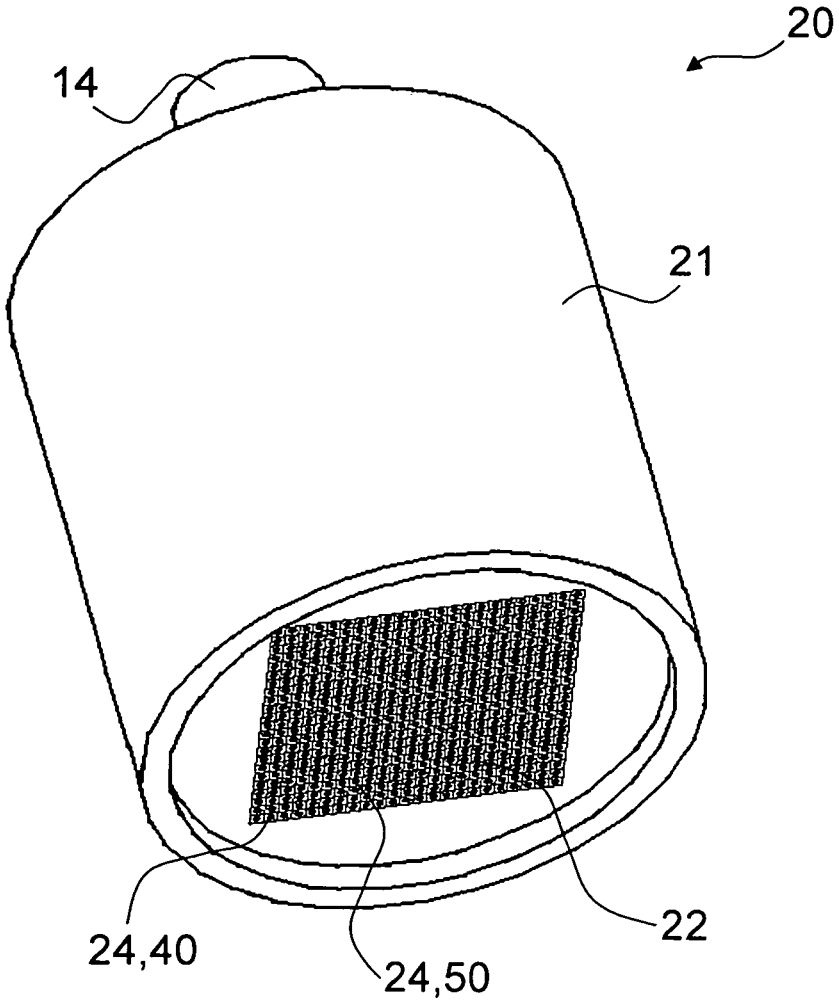
FIG. 2 shows a marking head according to the invention.

The principal structure of a marking apparatus 10 according to the invention is shown in FIGS. 1 and 2. The marking apparatus 10 comprises a marking head 20 with a plurality of marking devices 40 and a plurality of sensor devices 50. The apparatus 10 further comprises a control and driving unit 12 for controlling the marking devices 40 and the sensor devices 50. The control and driving unit 12 is connected to the marking head 20 through an umbilical 14. The umbilical 14 may have a plurality of fibres arranged therein.

The marking head 20 may in particular be a printing head and may have a cylindrical housing 21. The marking head 20 includes a plurality of receiving spaces 24 arranged in a two-dimensional array 22. The receiving spaces 24 are equipped with individual marking devices 40 and sensor devices 50. The sensor devices 50 may also be referred to as a detector devices.

Figure 3:
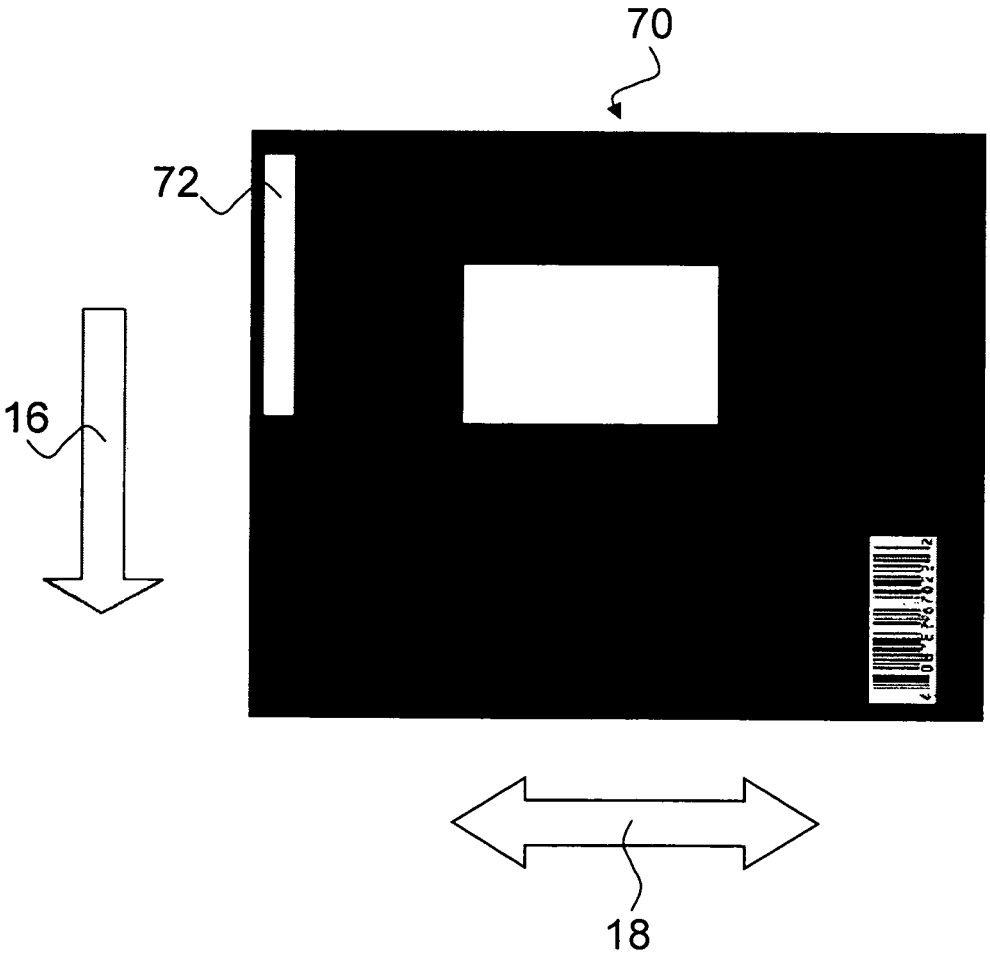
FIG. 3 shows an object with a marking area to be marked.

FIG. 3 shows an object 70 to be marked by the marking devices 40 of the marking apparatus 10. The object 70 comprises a marking area 72, which is a defined area, in which a marking 73 is to be placed. When the marking 73 is applied on the object 70, in particular in the marking area 72, the object 70 is moved along an advance direction 16. The advance direction 16 may also be referred to as an object movement direction.

Figure 4:
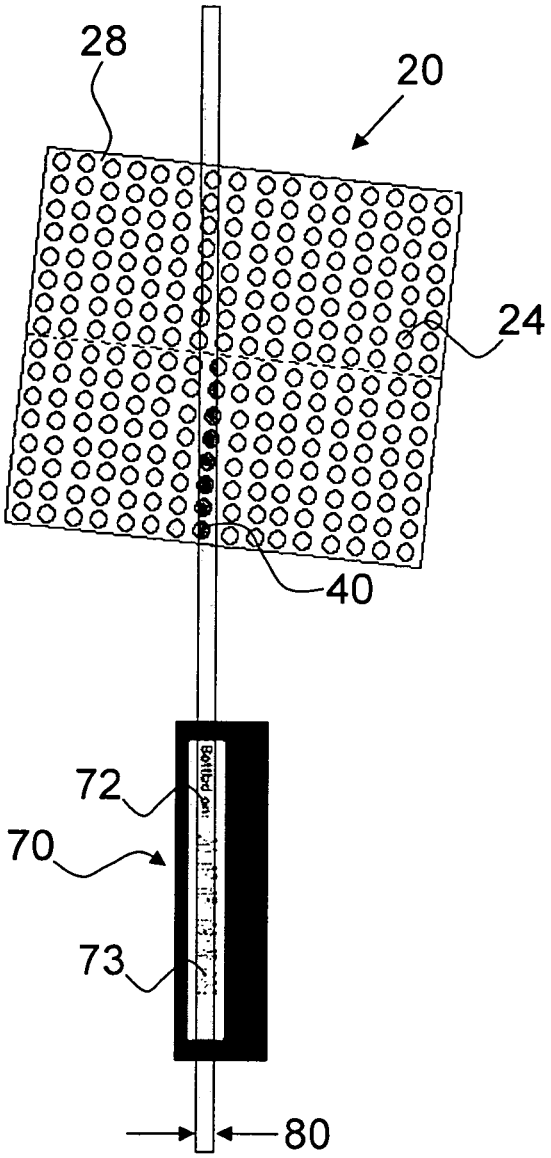
FIG. 4 shows a general embodiment of a marking head.

FIG. 4 shows a general embodiment of a marking head 20. The marking head 20 is equipped with a plurality of marking devices 40 arranged in a single column 32 which is inclined relative to the advance direction 16. The single column array of marking devices 40 provides a printing width 80 according to a width of the marking 73 to be applied. If the object 70 is displaced in a transverse direction 18 during a marking operation, the marking 73 may show artifacts or may be displaced, as shown in more detail in FIG. 5.

Figure 5:
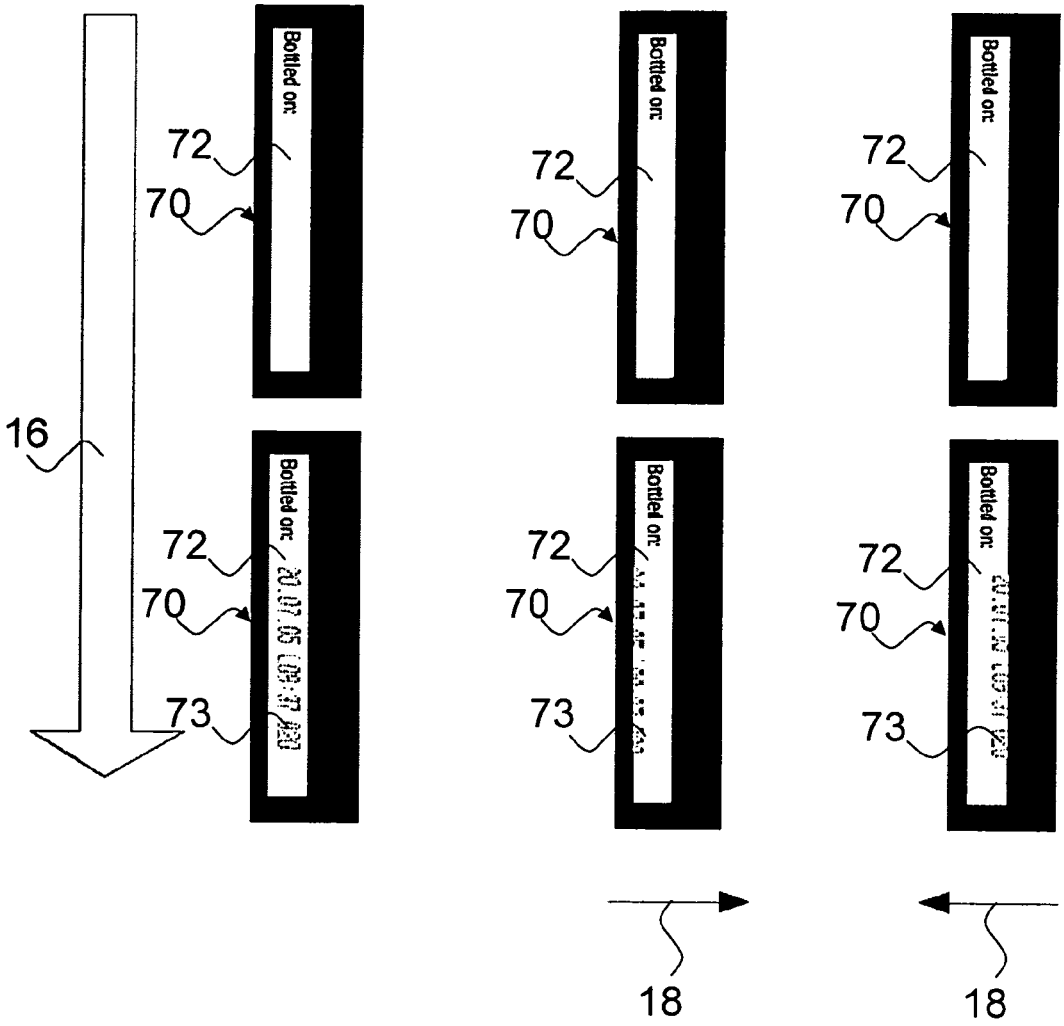
FIG. 5 shows an enlarged view of a marking area of an object.

In the left representation of FIG. 5 the marking 73 is applied in a predetermined or correct position in the marking area 72 of the object 70. In the middle representation of FIG. 5, the object 70 and the marking area 72 are shifted to the right, so that the marking 73 is displaced in the transverse direction 18 to the left. The right representation shows the object 70 in a displaced position to the left, so that the applied marking 73 is displaced to the right.

Figure 6:
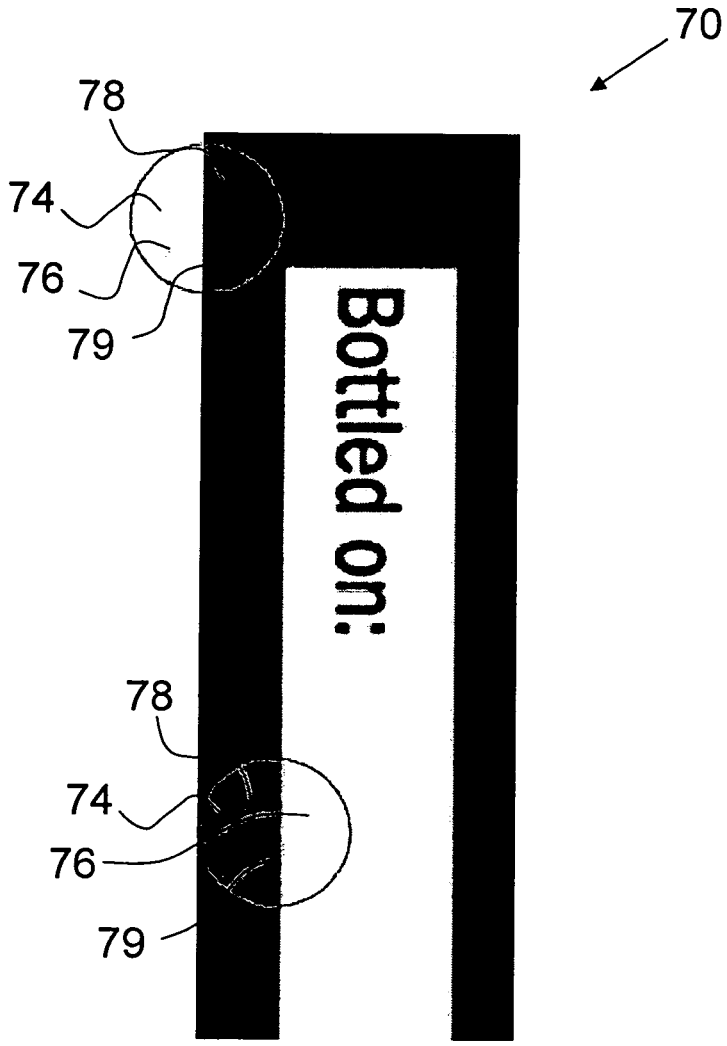
FIG. 6 shows an enlarged view of different contrast areas of an object.

FIG. 6 shows different contrast areas 74 of an object 70 which may be used for detecting the position of the object 70 in the transverse direction 18. The contrast areas 74, which may also be named contrast sensing areas, are in each case formed by a bright area 76 and a dark area 78. The bright area 76 and the dark area 78 are defined by a border line or high contrast line 79, which preferably extends along the advance direction 16. The bright area 76 of the contrast area 74 and/or the dark area 78 of the contrast area 74 may in particular be a part of the marking area 72, as is the case with the lower contrast area 74 shown in FIG. 6.

Figure 7:
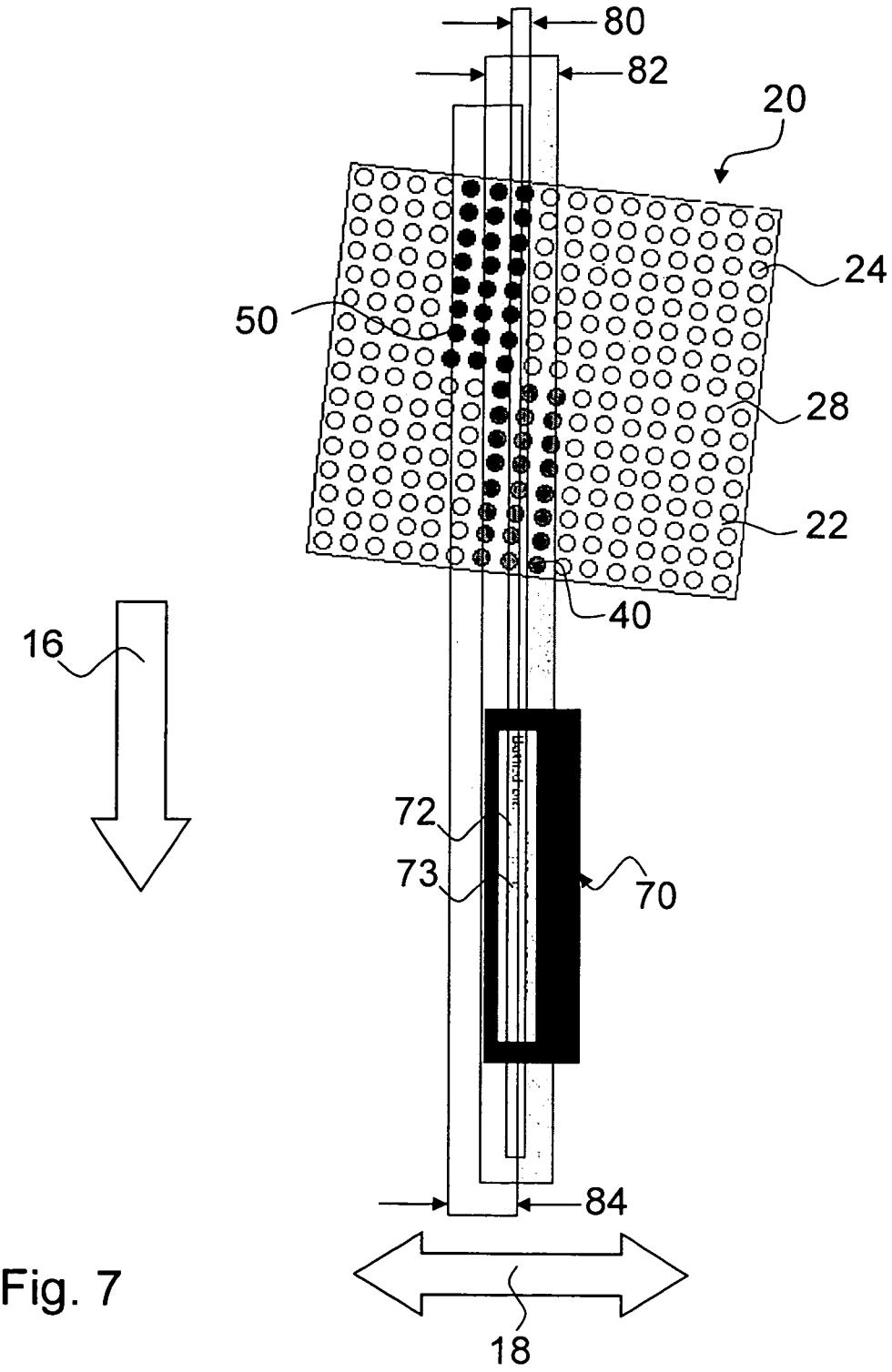
FIG. 7 shows a first embodiment of a marking head with a plurality of marking devices and a plurality of sensor devices according to the invention.
Figure 8:
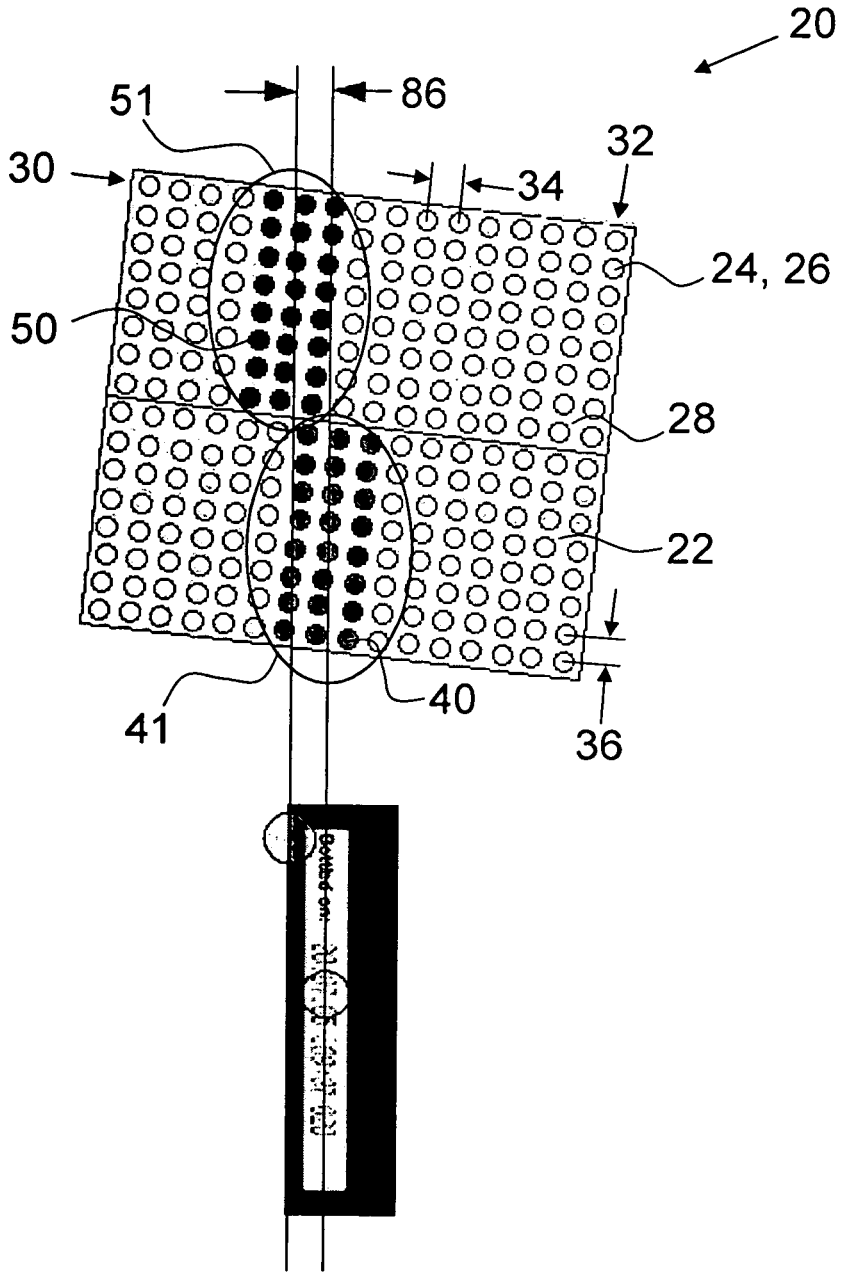
FIG. 8 shows a displacement of a sensor device array relative to a marking device array.

FIGS. 7 and 8 show a first embodiment of a marking head 20 of an inventive marking apparatus 10. The marking head 20 includes a plurality of receiving spaces 24 arranged in a two-dimensional array 22. The receiving spaces 24 are arranged in rows 30 and columns 32 extending perpendicularly to each other. In other words, the receiving spaces 24 are arranged in a rectangular or square pattern, which may also be called a matrix, in particular a two-dimensional matrix.

The receiving spaces 24 have equal distances or an equal spacing, so that a regular pattern is formed. The spacing between two adjacent receiving spaces 24, more particularly the distance between the central points of two adjacent receiving spaces 24 in one row, is called a row pitch 34. Accordingly, the spacing between two adjacent receiving spaces in one column 32 is called a column pitch 36. The receiving spaces 24 have equal row pitches 34 and equal column pitches 36. The array 22 of receiving spaces 24 has a rectangular outer shape.

The marking head 20 includes a receiving plate 28 having a plurality of receiving holes 26 forming the receiving spaces 24. The receiving plate 28 may for example be a metal plate, in particular a steel plate. The receiving holes 26 each have a substantially circular cross-section and may in particular be through-holes. The receiving holes 26 each have equal diameters.

The receiving spaces 24 are equipped with a plurality of marking devices 40 and a plurality of sensor devices 50. The marking devices 40 are arranged in a marking device sub-array 41 and the sensor devices 50 are arranged in a sensor device sub-array 51. The sensor device sub-array 51 is arranged upstream of the marking device sub-array 41 so that the position of the object 70 may be detected before applying the marking 73 on the object 70.

As shown in FIG. 7, the marking head 20 comprises more marking devices 40 than are needed to apply the marking 73 on the object 70. The marking devices 40 are in particular arranged in an array such that an extended marking width 82 is achieved which is greater than a base marking width 80, wherein the base marking width 80 corresponds to a width of the marking 73 to be applied. In other words, the extended marking width 82 is greater than a width of the marking 73 to be applied on the object 70. The base marking width 80, the extended marking width 82 and the width of the marking 73 extend in the transverse direction 18. The extended marking width 82 determines a maximum displacement compensation that is possible in the configuration.

The sensor devices 50 are arranged in the marking head 20 such that a contrast area sensing width 84 extending in the transverse direction 18 is covered. The contrast area sensing width 84 determines a maximum displacement that can be detected.

The array 22 of receiving spaces 24 is tilted or inclined with regard to the advance direction 16. The tilted position of the array 22 is in particular defined in that the rectangular pattern of rows 30 in columns 32 is tilted from a position in which the columns 32 are aligned with the advance direction 16 to a position in which the columns 32 are inclined or slanted with regard to the advance direction 16.

The tilted position of the array 22 or marking head 20, respectively, enhances the maximum possible resolution with regard to a marking operation to be performed by the marking devices 40 and a sensing or scanning operation to be performed by the sensor devices 50. In a preferred embodiment the array 22 is tilted to a degree such that the resolution is defined by the number of rows 30 times the number of columns 32, that is, by the mathematical product of the number of rows 30 and the number of columns 32. To this end, the array 22 is tilted to a degree, where the receiving spaces 24 of a successive row 30 are slightly offset with regard to the receiving spaces 24 of a preceding row 30, in particular such that the receiving spaces 24 overlap in the transverse direction.

FIG. 8 shows the marking head of FIG. 7, wherein a displacement 86 of the sensor device sub-array 51 relative to the marking device sub-array 41 in the transverse direction 18 is illustrated. The displacement 86 preferably corresponds to a distance in the transverse direction 18 between a middle line of the marking 73 to be applied in the marking area 72 and the contrast area 74, in particular the contrast line 79, on the object 70.

Figure 9:
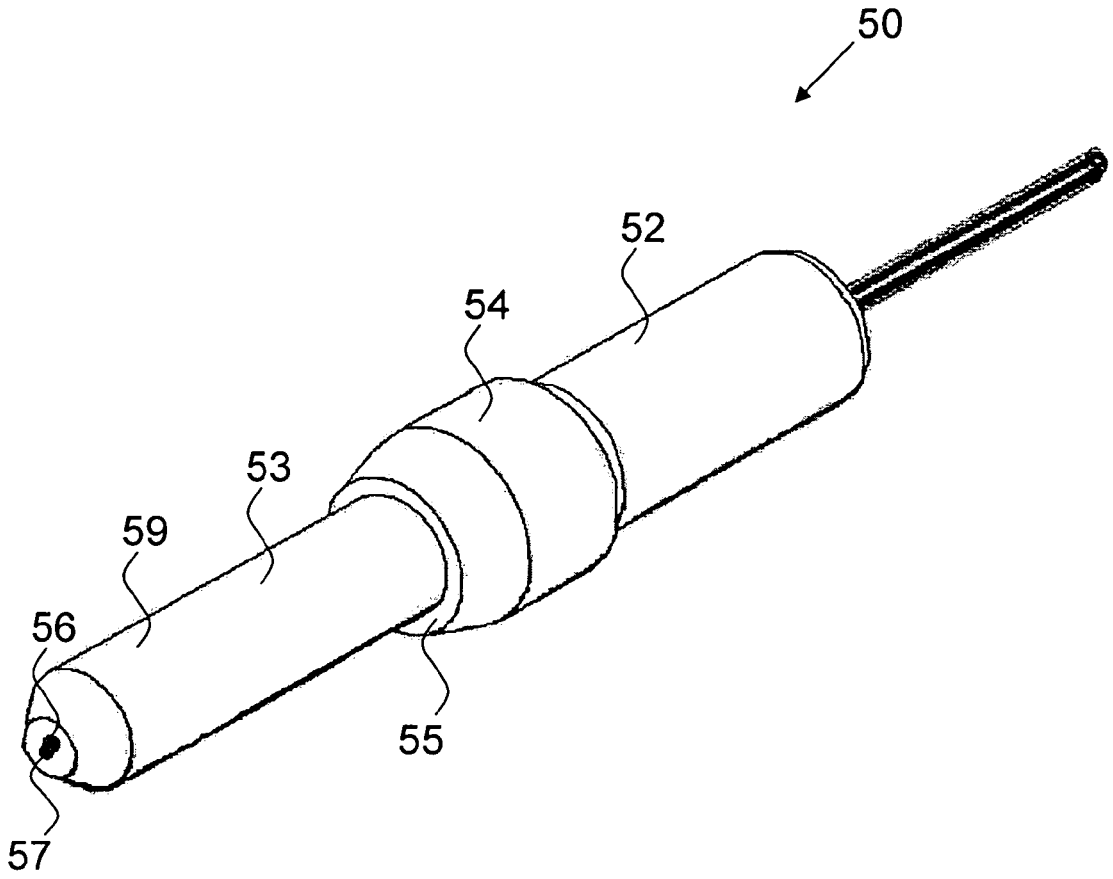
FIG. 9 shows an embodiment of a sensor device.

FIG. 9 shows an embodiment of a sensor device 50 in a ferrule-shape. The sensor device 50 comprises a ferrule 52 in which at least one transmitting fibre 56 and at least one receiving 57 is arranged. The ferrule 52 is configured for a mating engagement with the receiving spaces 24, in particular the receiving holes 26, of the marking head 20.

The ferrule 52 has an essentially cylindrical body 53 and can for example include a metal, a ceramic, a plastic material or glass. It may be particularly preferred that the ferrule 52 includes steel or zirconia.

The body 53 of the ferrule 52 has a connecting portion or a connector section 59 for engaging a receiving space 24 of the marking head 20. The connector section 59 has a substantially cylindrical shape for a mating engagement with a cylindrical receiving hole 26 provided in the receiving plate 28 of a marking head 20. The body 53 of the ferrule 52 further comprises a collar 54 with an abutment surface 55 for contacting a planar surface of the receiving plate 28.

The transmitting fibre 56 is arranged for transmitting light onto a surface of the object 70 to be marked. The receiving fibre 57 is arranged for receiving light reflected from the object 70. The transmitting fibre 56 and the receiving fibre 57 are arranged along a longitudinal axis of the ferrule 52. The receiving fibre 57 may be connected to a sensor element for detecting the light received by the fibre 57.

Figure 10:
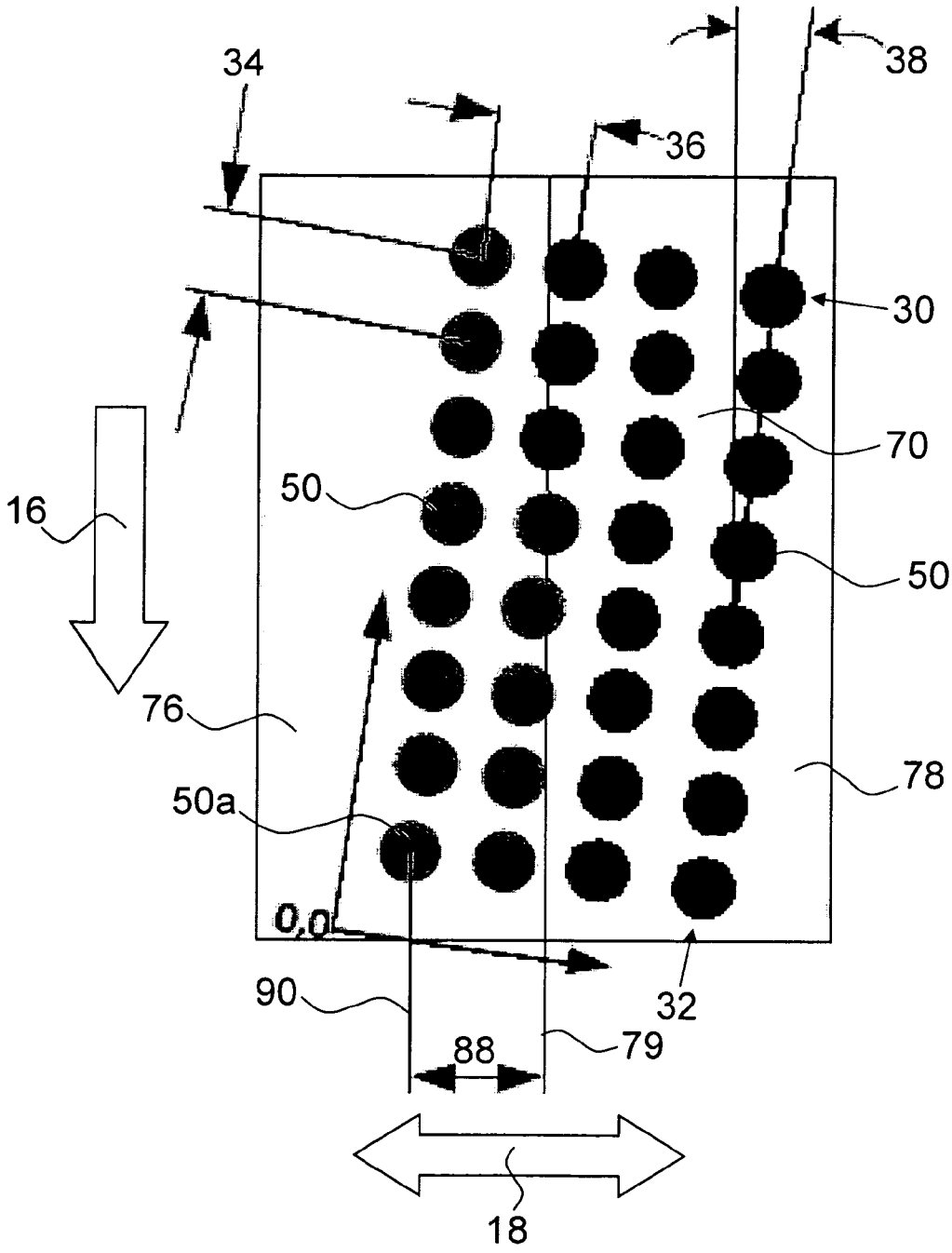
FIG. 10 shows a tilted array of sensor devices.

A method for determining the position of the contrast area 74 on the object 70 and thereby the position of the object 70 in the transverse direction 18 is shown in FIG. 10. The sensor devices 50 are organized in a two-dimensional sub-array 51 having a plurality of rows 30 and a plurality of columns 32. The array of sensor devices 50 is tilted by a tilt angle 38. In a preferred configuration the sensor devices 50 have equal row pitches 34 and equal column pitches 36, as illustrated in FIG. 10.

The sensor devices 50 are configured to distinguish different kinds of areas, for example a bright area 76 versus a dark area 78. Other sensor types may be used, such a distance sensors, to discriminate for example a narrow area versus a far area.

The array of sensor devices 50 can detect the position of the contrast area 74, in particular the position of the contrast line 79 between the bright area 76 and the dark area 78. As shown in FIG. 10, a first subset of sensor devices 50 will detect the bright area 76 and will e.g. give a sensor signal 'ON'. A second subset of sensor devices 50 will detect the dark area 78 and will e.g. give a sensor signal 'OFF'. The position of the contrast or border line may be determined based on the feedback of the individual sensor devices. The position of the contrast line 79 may for example be given as a distance 88 relative to a base line 90, wherein the base line 90 can be defined for example by a line going through a reference sensor device 50*a*.

The displacement of the object 70 in the transverse direction may be determined based on the known distance of the contrast area 74, in particular contrast line 79, relative to the marking area 72 of the object 70. The subset of marking devices 40 for performing the marking operation may then be elected based on the determined distance.

Figure 11:
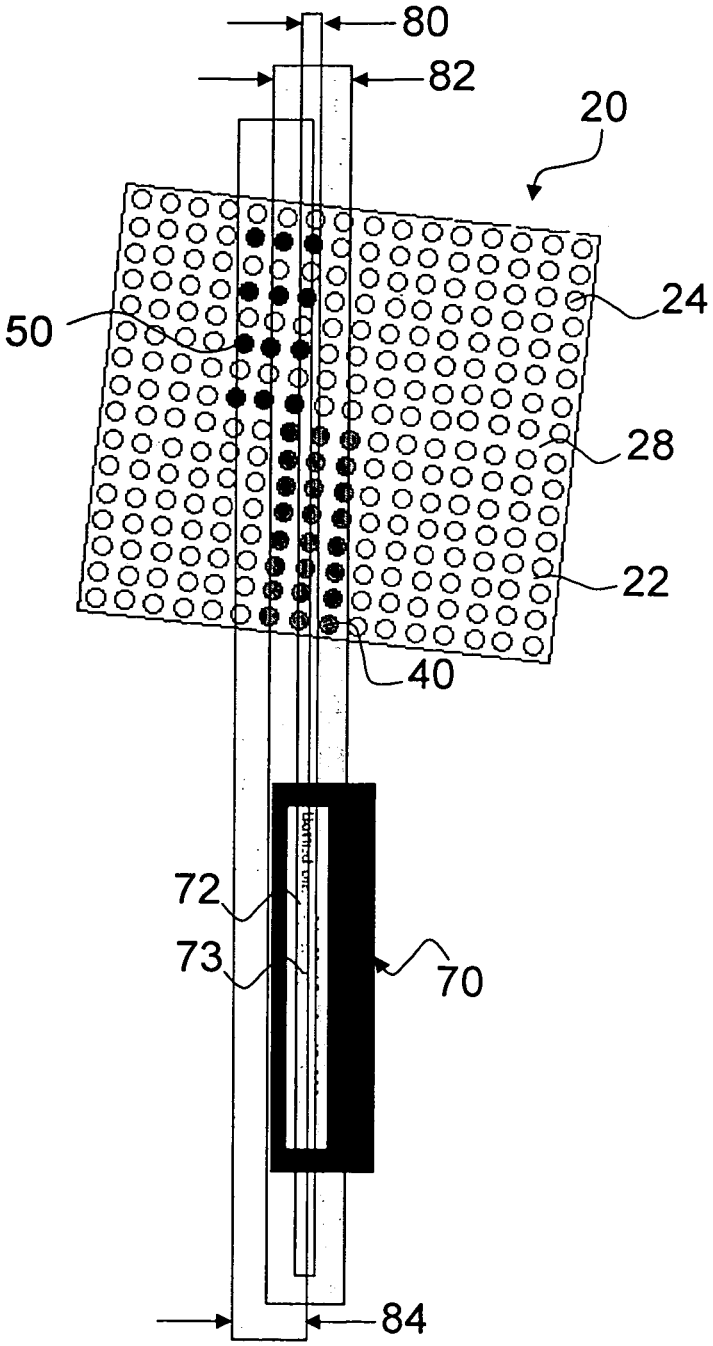
FIG. 11 shows a second embodiment of a marking head with a plurality of marking devices and a plurality of sensor devices according to the invention.

It may be noted, that the marking resolution does not necessarily need to match the sensor resolution. In particular, it is possible that the number of sensor devices 50 is smaller than the number of marking devices 40, as shown in FIG. 11.

According to the invention it may be preferred that the sensor device sub-array 51 and the marking device sub-array 41 are arranged in the same array 22 of receiving spaces 24, that is, in one receiving device or receiving plate, so that the distances between the sensor devices 50 and the marking devices 40 are always known and remain constant.

The invention claimed is:

1. A method for applying a marking on an object, wherein
the object is moved in an advance direction relative to a marking head comprising a plurality of individual marking devices, and
the marking is applied on the object by means of the plurality of marking devices during the relative movement between the object and the marking head,
wherein
for applying the marking on a predetermined marking area relative to a transverse direction, which extends transversely to the advance direction,
a position of the object in the transverse direction is determined by a sensor device arranged in the marking head,
wherein the position of the object in the transverse direction is determined during a marking operation, and
based on the determined position of the object in the transverse direction a first number of marking devices is deactivated and a second number of marking devices is activated, wherein the marking is applied on the object by the second number of marking devices,
wherein the plurality of marking devices are arranged in a plurality of rows extending in the transverse direction and the marking head is arranged in a position in which the marking devices of a successive row are offset with regard to marking devices of a preceding row in the transverse direction.

2. The method of claim 1, wherein
the position of the object in the transverse direction is determined by detecting the position of a contrast area on the object.

3. The method of claim 2, wherein
for detecting the position of the contrast area on the object, light is transmitted to the object, the light is at least partly reflected or scattered by the object and the reflected or scattered light is detected by a sensor element.

4. The method of claim 1, wherein
a marking image being a model of the marking to be applied on the object and having a plurality of pixels is pre-processed by shifting the pixels in a predetermined manner based on the determined position of the object in the transverse direction and
the pre-processed marking image is used for at least one of: activating and deactivating the marking devices.

5. A marking apparatus for applying a marking on an object comprising
a marking head having a plurality of individual marking devices for applying the marking on the object, and
a driving mechanism for providing a relative movement of the object relative to the marking head in an advance direction during a marking operation,
wherein
at least one sensor device is arranged in the marking head, the at least one sensor device being configured to determine a position of the object in a transverse direction, which extends transversely to the advance direction,
wherein the position of the object in the transverse direction is determined during a marking operation, and
the marking devices can be individually activated and deactivated based on the determined position of the object in the transverse direction,
wherein the marking devices are arranged in a plurality of rows extending in the transverse direction and the marking head is arranged in a position in which the marking devices of a successive row are offset with regard to marking devices of a preceding row in the transverse direction.

6. The marking apparatus of claim 5, wherein
the at least one sensor device is arranged upstream of the marking devices in the advance direction.

7. The marking apparatus of claim 5, wherein
the marking head comprises a plurality of receiving spaces for individual marking devices arranged in a two-dimensional array.

8. The marking apparatus of claim 7, wherein
the at least one sensor device is arranged in one of the receiving spaces of the array.

9. The marking apparatus of claim 7, wherein
the array of receiving spaces is an orthogonal array, in which the receiving spaces are arranged in rows and columns extending perpendicularly to each other.

10. The marking apparatus of claim 7, wherein
the receiving spaces have an equal spacing in at least one of: a row direction and a column direction.

11. The marking apparatus of claim 5, wherein
the at least one sensor device comprises a ferrule, in which are arranged a transmitting fibre for transmitting light to the object and a receiving fibre for receiving light reflected from the object.

12. The marking apparatus of claim 11, wherein
the ferrule has a keyed body for being inserted into a receiving hole of the marking head in a defined angular position.

* * * * *